US008398782B2

(12) United States Patent
Poyner et al.

(10) Patent No.: US 8,398,782 B2
(45) Date of Patent: Mar. 19, 2013

(54) PROTECTIVE ARRANGEMENT FOR A CONTROL DEVICE ASSOCIATED WITH A DISHWASHING APPLIANCE, AND ASSOCIATED APPARATUS AND METHOD

(75) Inventors: Dennis A. Poyner, Kinston, NC (US); David Sumner, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 1059 days.

(21) Appl. No.: 12/164,568

(22) Filed: Jun. 30, 2008

(65) Prior Publication Data

US 2009/0320886 A1 Dec. 31, 2009

(51) Int. Cl.
*B08B 3/00* (2006.01)

(52) U.S. Cl. ..... 134/56 D; 134/57 D; 134/58 D; 134/114

(58) Field of Classification Search ..... 134/115 R, 134/114, 56 D, 57 D, 58 D
See application file for complete search history.

(56) References Cited

U.S. PATENT DOCUMENTS

| | | | | |
|---|---|---|---|---|
| 3,064,662 | A | 11/1962 | Given et al. | |
| 3,467,761 | A * | 9/1969 | Plummer | 174/36 |
| 3,519,796 | A | 7/1970 | Bebinger | |
| 3,936,107 | A | 2/1976 | Gourdeau et al. | |
| 4,032,821 | A | 6/1977 | Keiser | |
| 4,122,203 | A * | 10/1978 | Stahl | 428/318.4 |
| 4,901,676 | A | 2/1990 | Nelson | |
| 5,039,828 | A | 8/1991 | Marks et al. | |
| 5,366,185 | A | 11/1994 | Michael et al. | |
| 5,473,111 | A * | 12/1995 | Hattori et al. | 174/363 |
| 5,760,493 | A | 6/1998 | Outcalt et al. | |
| 2003/0205954 | A1 * | 11/2003 | Oyler et al. | 312/311 |
| 2005/0126608 | A1 * | 6/2005 | DeWeerd et al. | 134/56 D |
| 2008/0000506 | A1 | 1/2008 | Pyo et al. | |
| 2008/0134728 | A1 * | 6/2008 | Son | 68/212 |
| 2008/0196751 | A1 | 8/2008 | Poyner et al. | |
| 2009/0288692 | A1 | 11/2009 | Haeberle et al. | |

FOREIGN PATENT DOCUMENTS

| | | |
|---|---|---|
| BR | 199900315 | 2/1999 |
| CN | 1887200 A | 1/2007 |
| EP | 0 944 147 A1 | 9/1999 |
| EP | 944147 A1 | 9/1999 |

(Continued)

OTHER PUBLICATIONS

Notice of Allowance issued for U.S. Appl. No. 12/493,729, mailed Jun. 19, 2012.

(Continued)

*Primary Examiner* — Michael Barr
*Assistant Examiner* — Charles W Kling
(74) *Attorney, Agent, or Firm* — Alston & Bird LLP

(57) ABSTRACT

A protective arrangement for protecting a control device associated with a dishwashing appliance is provided. A door assembly is pivotably engaged with a tub portion of the dishwashing appliance and cooperates therewith to cover a forward access opening defined by the tub portion. The control device is mounted to the door assembly and is adapted to selectively direct operation of at least one operational component of the dishwashing appliance. The protective arrangement is configured to wrap about the control device so as to be at least partially disposed between the control device and door assembly. The protective member is further disposed between a detergent dispensing device and the control device to at least partially prevent contact between dishwashing fluid from the detergent dispensing device and the control device. An associated apparatus and method are also provided.

23 Claims, 6 Drawing Sheets

FOREIGN PATENT DOCUMENTS

| | | | |
|---|---|---|---|
| EP | 1 421 893 | A1 | 5/2004 |
| EP | 1 714 604 | A1 | 10/2006 |
| EP | 1 929 926 | A2 | 6/2008 |
| JP | 54065753 | A | 5/1979 |
| JP | 2006280402 | A | 10/2006 |
| WO | WO 02/02318 | A1 | 1/2002 |

OTHER PUBLICATIONS

Office Action and Search Report for Chinese Application No. 200980126145.3 dated Oct. 19, 2012.

* cited by examiner

PROTECTIVE ARRANGEMENT FOR A CONTROL DEVICE ASSOCIATED WITH A DISHWASHING APPLIANCE, AND ASSOCIATED APPARATUS AND METHOD

BACKGROUND OF THE INVENTION

1. Field of the Invention

Embodiments of the present invention relate to dishwashing appliances and, more particularly, to a protective arrangement for protecting a control device associated with a dishwashing appliance, and an apparatus and method associated therewith.

2. Description of Related Art

A washing appliance, such as a dishwasher, generally includes a tub portion having a forward-facing vertical opening, wherein a door is engaged with the tub portion so as to be pivotable about the lower end of the tub portion and to close the tub opening during the washing process. In this regard, conventional dishwashers may include a door having a separate polymeric "inner lining" component (i.e., the inward surface of the door facing the interior of the tub portion). However, in such instances, if the polymeric inner lining is to be used for any structural purpose in the dishwasher, the inner liner must be appropriately reinforced by another separate structure. For example, a door assembly may include a plastic door liner and a metal reinforcement panel which is staked to the plastic door liner. In such instances, the metal reinforcement panel provides additional stiffness, strength, and provisions to which to attach various mechanisms and components, such as counterbalance arms/hinges for providing the pivotable engagement with the tub portion.

Such a dishwasher door assembly may also include a control panel engaged therewith about the upper end of the door assembly, often in a dedicated recess configured to receive the control panel in a confined space, wherein the control panel directs the operation/actuation of various operational components of the dishwasher. Such a control panel may include, for example, a timer device for controlling certain aspects of the dishwasher. The control panel/timer device may be connected by an appropriate wiring harness run outside the metal reinforcement panel (i.e., the metal reinforcement panel separates the wires running to the control panel from the plastic or polymeric door liner) and routed over existing structures associated with the bottom of the door assembly, to the operative components of the dishwasher housed within a base component of the dishwasher under the tub portion.

Further, a dishwasher door configured in such a manner may use the metal reinforcement panel as a "flame barrier". That is, the metal reinforcement panel may act as a barrier for flame advancement should the control panel/timer device catch on fire. However, the metal reinforcement panel may not necessarily be configured to prevent fluid leakage (i.e., from a detergent dispenser) from contacting the wiring harness, the control panel and/or the timer device. The dedicated space defined by the metal reinforcement panel for receiving the control panel/timer device may be particularly configured for this purpose. However, the metal reinforcement panel may not necessarily be configured to prevent fluid leakage from contacting the control panel/timer device, wherein, in such instances, the fluid leakage contacting the control panel/timer device may lead to the aforementioned fire hazard.

Alternatively, in some instances, a dishwasher may employ a door assembly formed without the separate metal reinforcement panel. For example, a molded structural inner door member may be implemented, wherein such an integrally molded and structurally reinforced inner door member eliminates the need for a separate metal reinforcing panel. However, in doing so, the "flame barrier" function of the metal reinforcement panel is eliminated, and the control panel/timer device may still be at risk of undesirable contact with leaking fluids such as, for example, from the detergent dispenser.

Thus, there exists a need for an apparatus and method for a dishwashing appliance for reducing potential hazards/risks associated with a control panel/timer device of a dishwasher.

BRIEF SUMMARY OF THE INVENTION

The above and other needs are met by the present invention which, according to one aspect, provides a dishwashing appliance comprising a tub portion defining a forward access opening, and a door assembly configured to cooperate with the tub portion to cover the forward access opening. A detergent dispensing device is operably engaged with the door assembly so as to be capable of interacting with dishwashing fluid circulated within an interior of the tub portion. A control device is mounted to the door assembly and is adapted to selectively direct operation of at least one operational component of the dishwashing appliance. The dishwashing appliance further comprises a protective member configured to wrap about the control device so as to be at least partially disposed between the control device and door assembly. The protective member is further disposed between the detergent dispensing device and the control device to at least partially prevent contact between dishwashing fluid from the detergent dispensing device and the control device.

Another aspect provides a protective arrangement for a dishwashing appliance having a tub portion defining a forward access opening, wherein the dishwashing appliance further includes a door assembly being pivotably engaged with the tub portion and adapted to cooperate with the tub portion to cover the forward access opening. The dishwashing appliance further includes a control device mounted to the door assembly and adapted to selectively direct operation of at least one operational component of the dishwashing appliance. Such a protective arrangement comprises a substantially planar protective member comprised of a deformable material. The protective member has a leading end and a trailing end, and is adapted to be wrapped about a control device mounted to a door assembly of a dishwashing appliance such that the leading end at least partially overlaps the trailing end. The protective member is thereby at least partially disposed between the control device and the door assembly so as to at least one of protect and isolate the control device.

Yet another aspect provides a method of protecting a control device mounted to a door assembly of a dishwashing appliance, wherein the dishwashing appliance includes a tub portion defining a forward access opening. The door assembly is pivotably engaged with the tub portion and adapted to cooperate with the tub portion to cover the forward access opening. A detergent dispensing device is operably engaged with the door assembly so as to be capable of interacting with dishwashing fluid circulated within an interior of the tub portion. The control device is adapted to selectively direct operation of at least one operational component of the dishwashing appliance. Such a method comprises wrapping a protective member about a control device mounted to a door assembly of a dishwashing appliance such that the protective member is at least partially disposed between the control device and door assembly, and such that the protective member is further disposed between the detergent dispensing device and the control device to at least partially prevent contact between dishwashing fluid from the detergent dispensing device and the control device.

Thus, various aspects of the present invention provide advantages, as otherwise detailed herein, that may include, but are not limited to: providing protective measures for reducing hazards/risks associated with a control device of a dishwasher.

BRIEF DESCRIPTION OF THE SEVERAL VIEWS OF THE DRAWINGS

Figure 1:
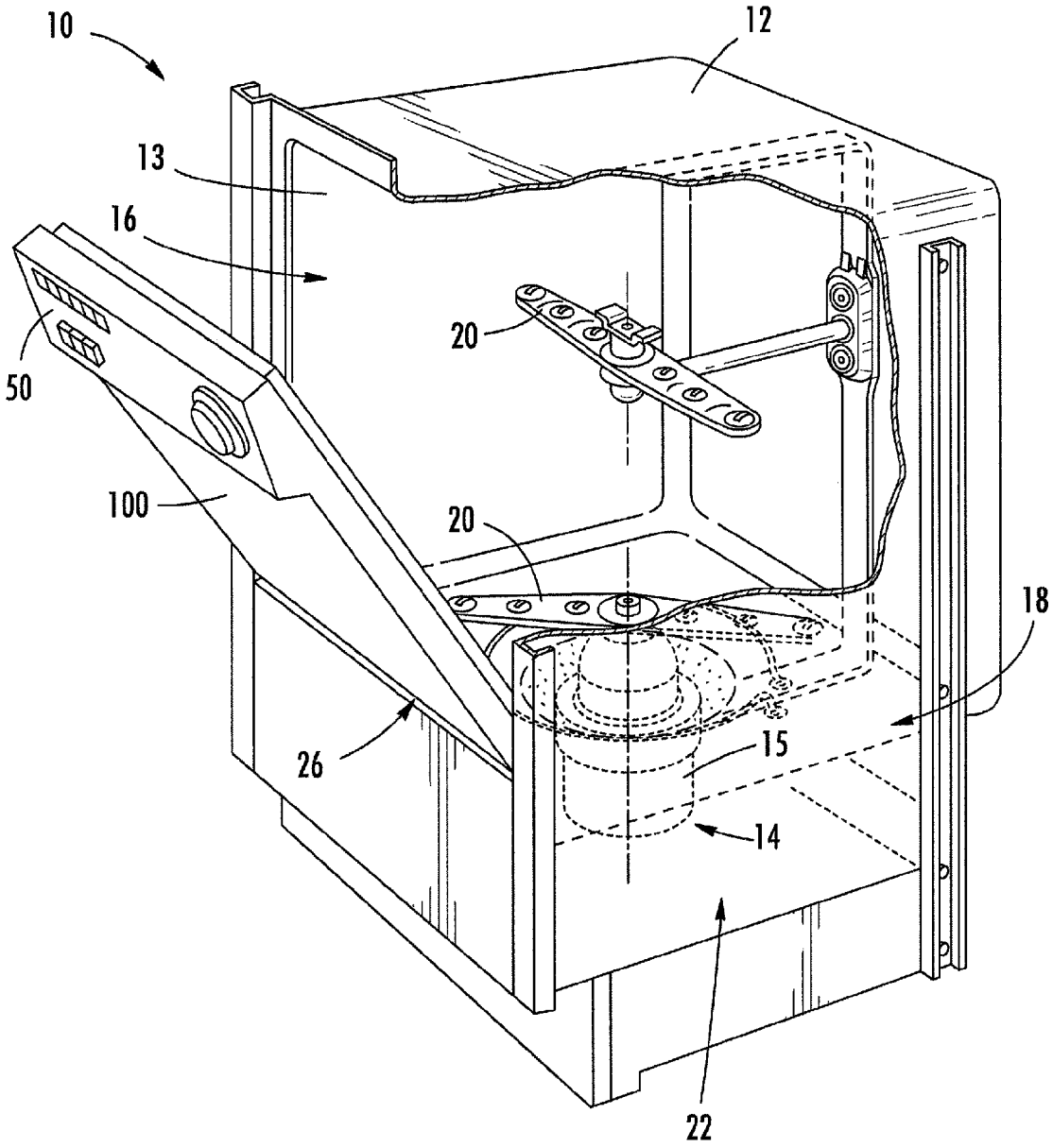
Figure 2:
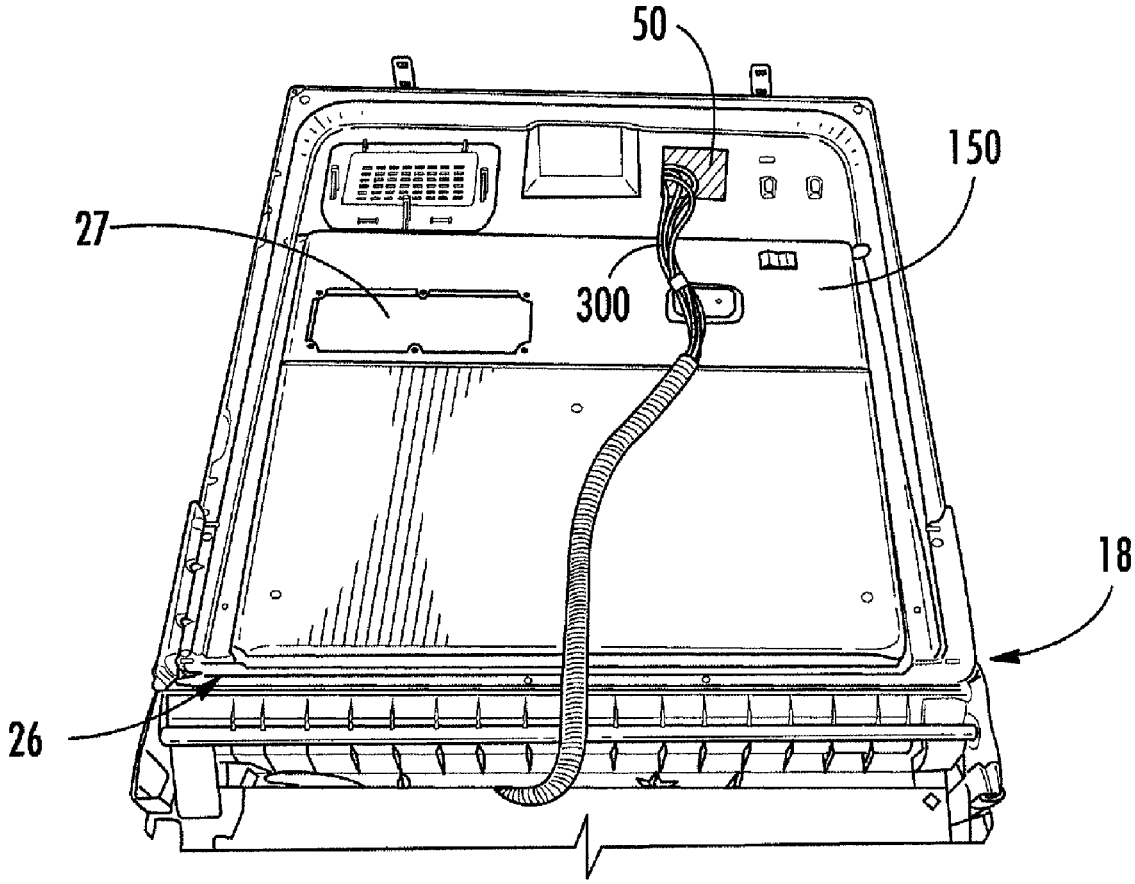
Figure 3:
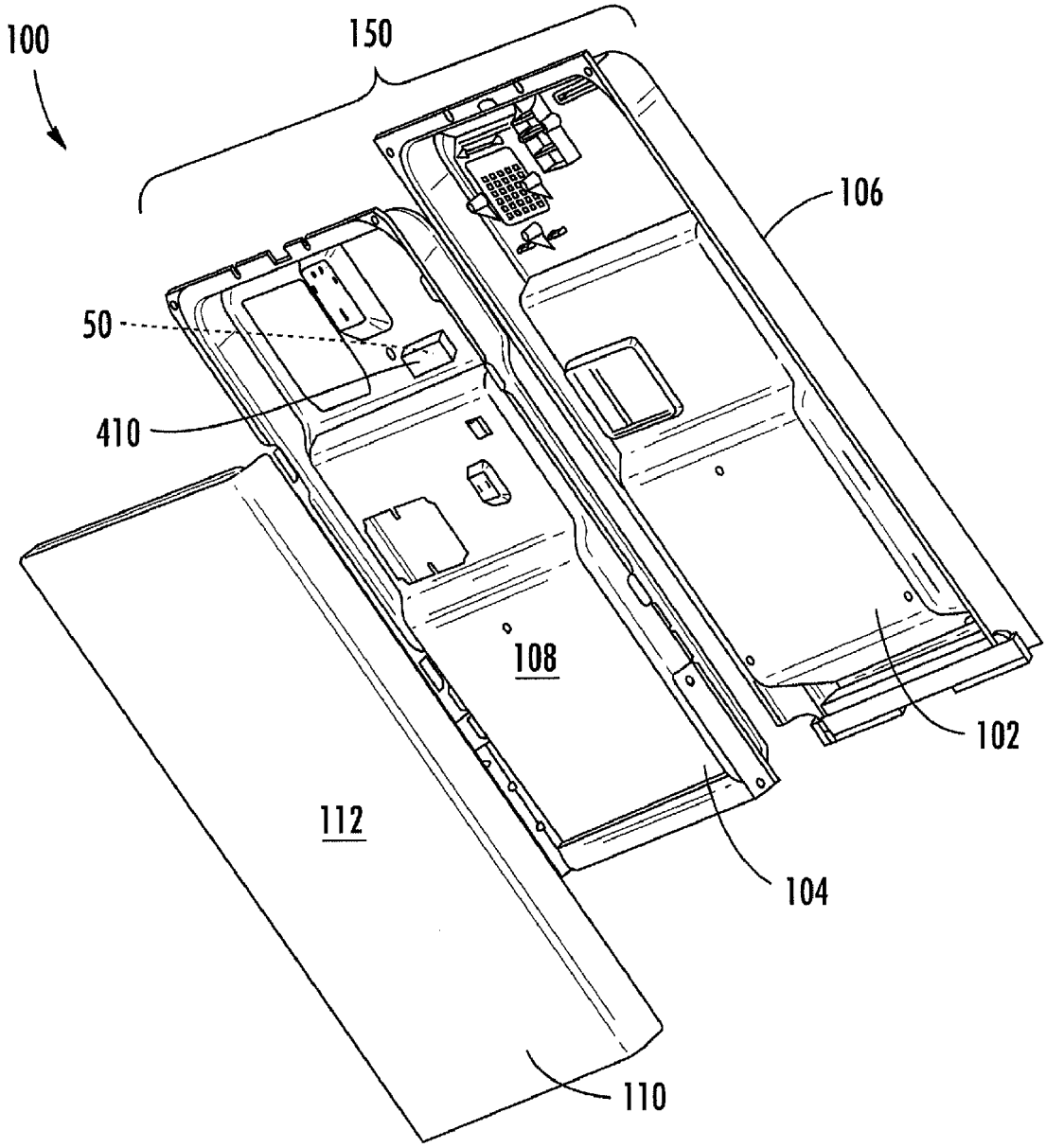
Figure 4:
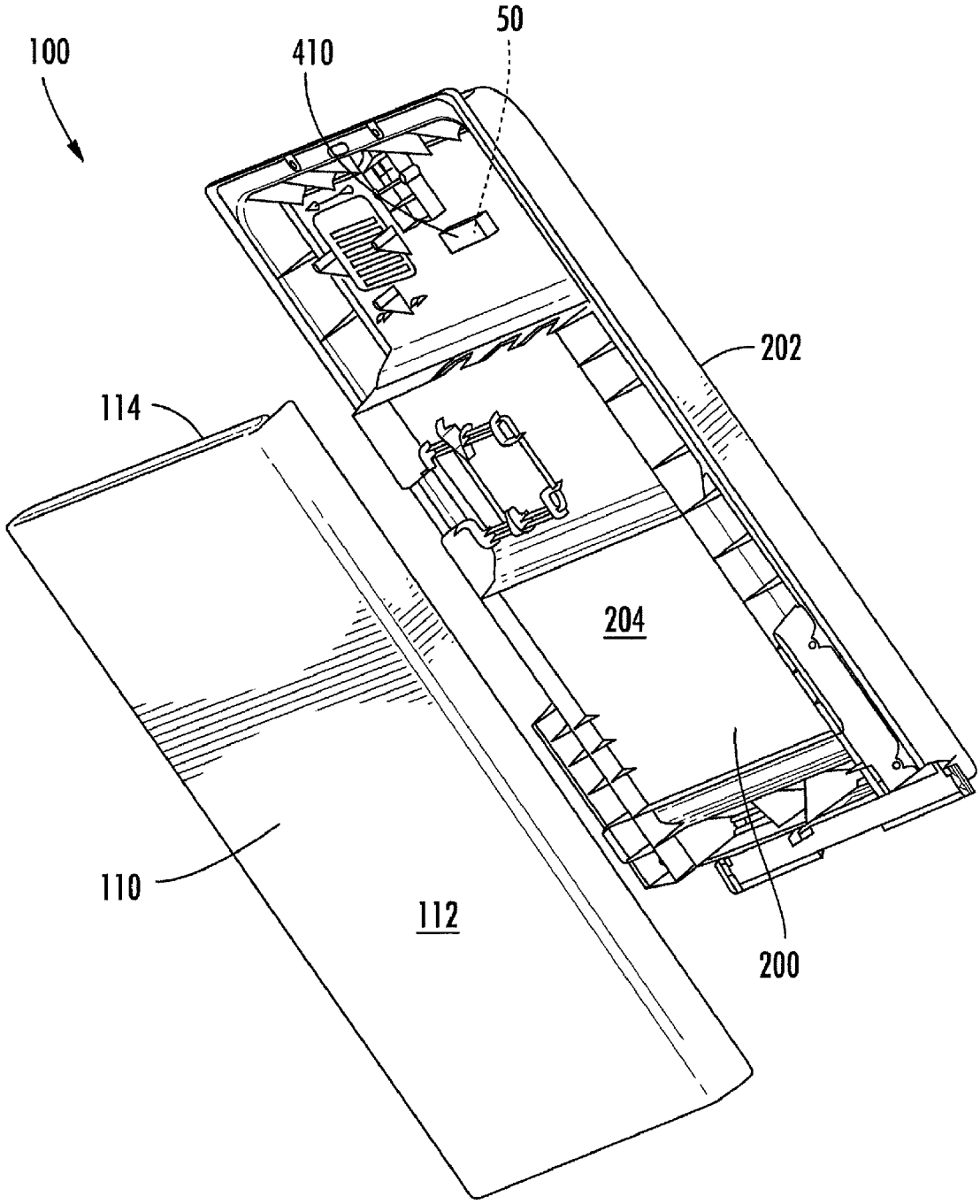
Figure 5:
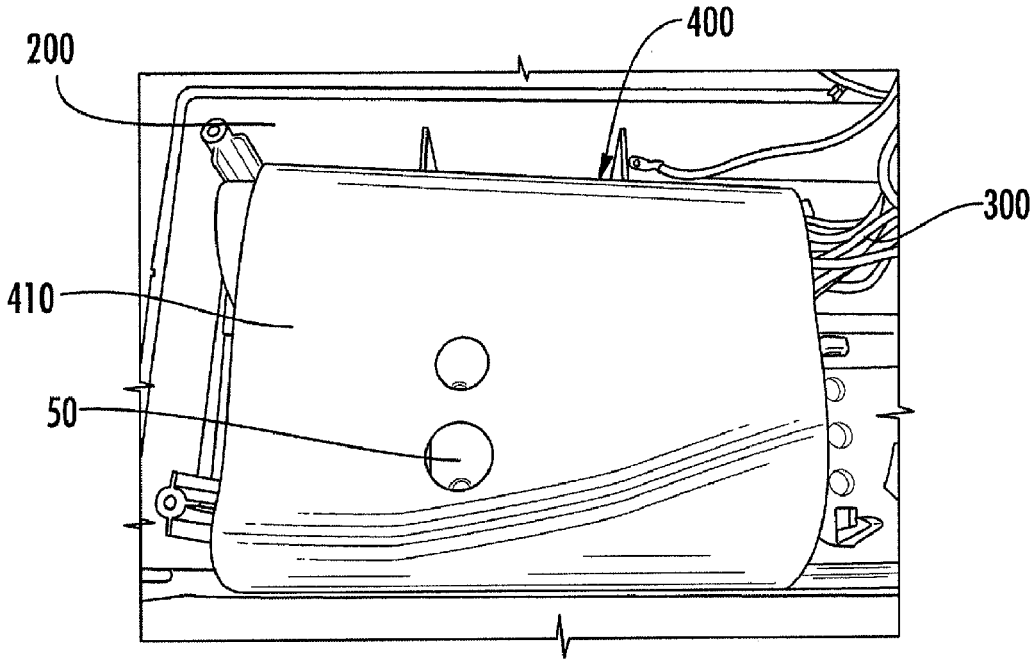
Figure 6:
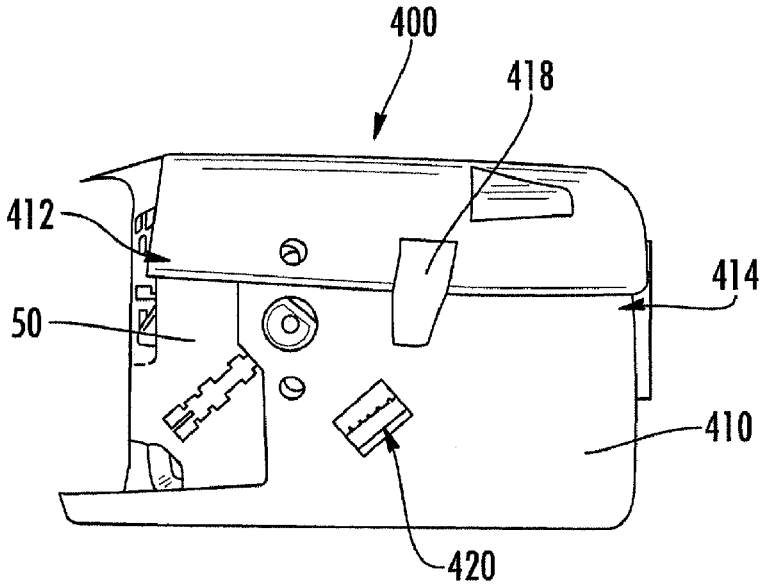
Figure 7:
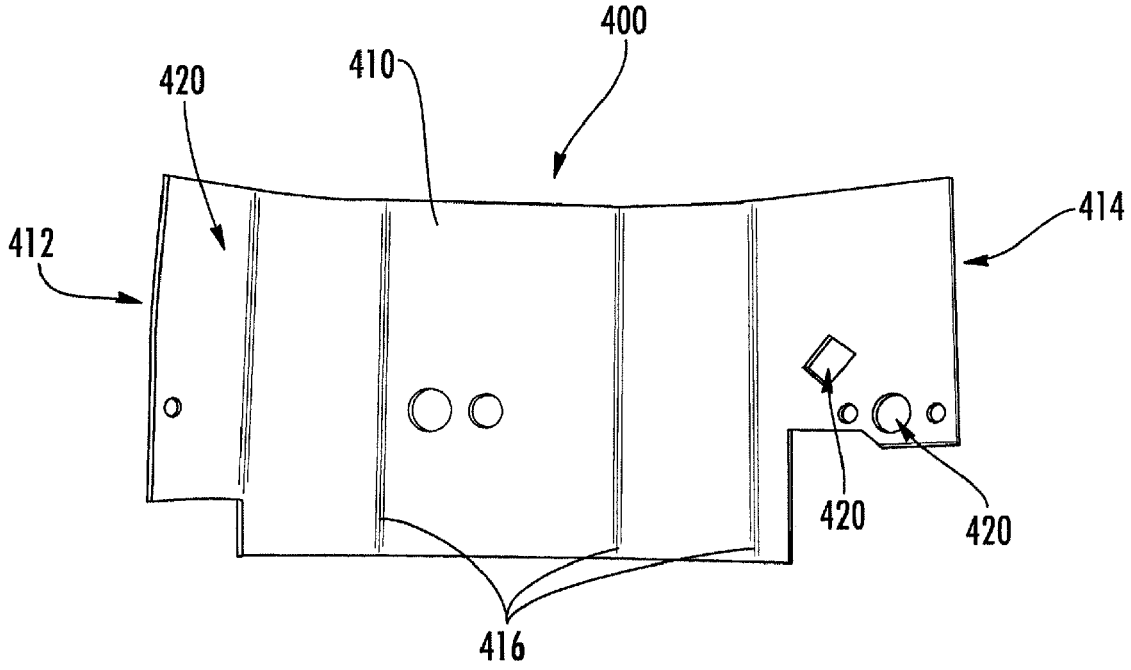

Having thus described various embodiments of the invention in general terms, reference will now be made to the accompanying drawings, which are not necessarily drawn to scale, and wherein:

FIG. 1 is a perspective view of a dishwasher capable of implementing various embodiments of the present disclosure;

FIG. 2 is a perspective view of a dishwashing appliance with an outer decorative door panel removed from a door assembly so as to illustrate a wiring arrangement extending from a control device associated with the door assembly to various operational components housed in a base component of the dishwashing appliance;

FIG. 3 is an exploded perspective front view of a door assembly having a protective arrangement, according to one embodiment of the present invention, for protecting a control device mounted to the door assembly, wherein the door assembly implements a liner panel and a separate reinforcement panel;

FIG. 4 is an exploded perspective front view of a door assembly having a protective arrangement, according to one embodiment of the present invention, for protecting a control device mounted to the door assembly, wherein the door assembly implements an integrally-formed inner door panel;

FIG. 5 is a top plan view of a protective arrangement covering a control device mounted to a door assembly, according to one embodiment of the present invention;

FIG. 6 is a bottom plan view of a protective arrangement extending about a control device to be implemented in association with a door assembly of a dishwasher, according to one embodiment of the present invention; and FIG. 7 is a plan view of a protective arrangement according to one embodiment of the present invention.

DETAILED DESCRIPTION OF VARIOUS EMBODIMENTS OF THE INVENTION

Various embodiments of present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates one example of a dishwasher 10 capable of implementing various embodiments of the present invention. Such a dishwasher 10 typically includes a tub portion 12 (partly broken away in FIG. 1 to show internal details, and also referred to herein as "tub" or "tub 12") having a plurality of walls (e.g., side wall 13) for forming an enclosure in which dishes, utensils, and other dishware may be placed for washing. The tub portion 12 may also define a forward access opening, generally designated as 16. As known in the art, the dishwasher 10 may also include slidable bottom and upper racks (not shown) for holding the dishes, utensils, and dishware. The tub portion 12 may define a sump, generally designated as 14, in which wash water or rinse water is collected, typically under the influence of gravity. The wash/rinse water may be pumped by a pump 15 out of the sump 14 to various spray arms 20 mounted in the interior of the tub portion 12 for spraying the wash/rinse water, under pressure, onto the dishes, utensils, and other dishware contained therein. The pump 15 and/or other operational components (e.g., circulation pump, drain pump, water valve) may be housed, disposed, or otherwise positioned within a base portion/component 22 positioned beneath the tub portion 12, wherein the base portion 22 receives and supports a lower end, generally designated as 18, of the tub portion 12. In some instances, the base portion 22 may be a separate component with respect to the tub portion 12, such as, for example, a molded polymer component, while in other instances the base portion 22 may be integral with the tub portion 12 such that the side walls forming the tub portion 12 also at least partially form the base portion 22.

A door assembly 100 may be pivotably engaged with the tub portion 12 about the lower end 18 thereof so as to selectively permit access to the interior of the tub portion 12. That is, a lower edge 24 of the door assembly 100 may be pivotably engaged (i.e., hinged) with the lower end 18 of the tub portion 12 such that the door assembly 100 is pivotable about the lower edge 26 thereof to provide access to the interior of the tub portion 12 through the forward access opening 16, and to cover and seal the forward access opening 16 when the dishwasher 10 is in operation. Examples of such door assemblies 100 are also illustrated in FIGS. 3 and 4. A detergent dispensing device 27 (FIG. 2) may be operably engaged with the door assembly 100 so as to be capable of interacting with dishwashing fluid circulated within an interior of the tub portion 12.

As illustrated in FIGS. 1 and 2, the dishwasher 10 may further include a control device 50. The control device 50 may include, for example, a circuit board, a control panel, a timer device or other control unit (for controlling certain aspects of the dishwasher 10) that is otherwise in electrical communication with one or more controller elements and/or user interfaces, which may be mounted in/on the door assembly 100 (i.e., control switches mounted to the top of the door assembly 100 or the front of the door assembly 100) of the dishwasher 10 or otherwise associated with the door assembly 100. The control device 50 may further be in communication, via a wiring arrangement 300, such as, for example, a wiring harness, with various operational components (e.g., circulation pump, drain pump, water valve) of the dishwasher 10, wherein such operational components may thus be controlled via the control device 50, as initiated through the controller elements and/or user interfaces mounted on the door assembly 100. In some instances, the operational components may be disposed within or proximate to the base portion 22 such that the wiring arrangement 300 extends from about the top portion of the door assembly 100 and along the door assembly 100 to the base portion 22.

With continuing reference to FIG. 2, according to some embodiments, the control device 50 may be engaged with the door assembly 100 about the upper end thereof. For example, in some instances, the control device 50 may be engaged with the door assembly 100 in a dedicated recess (not shown) configured to receive the control device 50 in a defined space (for example, when the control device 50 is a control panel and/or a timer device). The control device 50, in such instances, may be connected by an appropriate wiring arrangement 300 run outside an inner door panel 150 and routed over existing structures associated with the bottom portion 26 of the door assembly 100 and/or the lower end 18 of the tub portion 12, to the operative components of the dishwasher 10 housed within the base portion 22 of the dishwasher 10 under the tub portion 12. As such, the wiring arrangement 300 (e.g., a wiring harness) may extend along the door assembly 100 to provide an electrical connection between the control device 50 and the operational components.

As shown in FIG. 3, the control device 50 may be configured for use and association with a door assembly 100 of a dishwasher 10, the door assembly 100 having an inner door member 150 (otherwise referred to herein as "inner door panel 150") comprising a liner panel 102 and a separate reinforcement member 104, wherein the liner panel 102 and the reinforcement member 104 are fastened together and configured for attachment to the tub portion 12 (FIG. 1) of the dishwasher 10 (FIG. 1). The liner panel 102 may be comprised of a polymeric material to form a polymeric inner lining, wherein the visible side 106 of the liner panel 102 when coupled to the reinforcement member 104 (e.g., by screws, rivets or the like) forms the inward surface of the inner door panel 150 facing the interior of the tub portion 12. Since, the polymeric liner panel 102 is generally flexible, the reinforcement member 104 is coupled to the liner panel 102 so as to reinforce the liner panel 102 and to provide structural integrity thereto. Accordingly, the reinforcement member 104 may comprise a metal material, wherein the metal reinforcing panel can be staked to the polymeric inner panel 102 for providing structural rigidity thereto. In such a configuration, a first surface 108 of the reinforcement member 104 faces outwardly from the interior of the tub 12. In such door assemblies, the control device 50 may be at least partially disposed externally to the reinforcement member 104 with respect to the inner panel 102 such that the reinforcement member 104 provides a "flame barrier" between the control device 50 and the inner panel 102. In such instances, however, the reinforcement member 104 may not necessarily be configured to prevent fluid leakage (e.g., from the detergent dispensing device 27) from contacting the control device 50, wherein, in such instances, the fluid leakage contacting the control device 50 may lead to a fire hazard.

With continuing reference to FIG. 3, the door assembly 100 may further include a decorative panel 110 for providing an exterior viewable and/or decorative portion of the door assembly 100. Thus, an exterior surface 112 of the decorative panel 110 is configured to face outwardly of the interior of the tub portion 12 so as to provide an aesthetically configured door assembly 100. The outer panel 110 may be configured to attach to the inner door panel 150 (i.e., the combined liner panel 102 and reinforcement member 104) such that the metal reinforcement member 104 is disposed therebetween. In this manner, the reinforcement member 104 may be concealed within the door assembly 100 formed between the liner panel 102 and the outer panel 110. The outer panel 110 is typically comprised of, for example, a polymeric material, a wood material or a metal material such as stainless steel. In such door assemblies, the control device 50 may be at least partially disposed between the reinforcement member 104 and the decorative panel 110, wherein one or more controller elements and/or user interfaces may be included or otherwise associated with the door assembly 100 for actuating various operational components of the dishwasher 10 via the control device 50. One of ordinary skill in the art will appreciate that, in some instances, the control device 50 may be mounted to, secured to, or otherwise engaged with the decorative panel 110 rather than the reinforcement member 104 or other component of the door assembly 100.

In other instances, as shown in FIG. 4, the control device 50 may be configured for use and association with a door assembly 100 comprising an integrally-formed and structurally reinforced door panel member 200 and the decorative panel 110, wherein the inner door panel member 200 (otherwise referred to herein as "inner door panel 200") and the decorative panel member 110 (otherwise referred to herein as "decorative panel 110") may be configured to be operably engaged or secured together to form the door assembly 100. When secured together, the decorative panel 110 is externally disposed to the inner door panel 200, with respect to the interior of the tub portion 12, wherein the decorative panel 110 and the inner door panel 200 may be configured to cooperate to define a space therebetween such that the control device 50 may be at least partially disposed therein.

Such an inner door panel 200 may be comprised of a variety of different polymers and/or composite materials. For example, the inner door panel 200 may be integrally formed as a single component or otherwise integral structure (i.e., integrally-molded using materials that may include, but are not limited to: polymers and composite materials, such as, for example, a molded polymer panel or a fiberglass panel). For example, the inner door panel 200 may be integrally-molded or otherwise integrally-formed from a polymeric material, such as talc-filled polypropylene. As shown generally in FIG. 4, the inner door panel 200 may comprise one or more integrally-molded members or component mounting structures that cooperate to receive and/or secure at least one or a variety of operative components thereto. For example, the inner door panel 200 may include integrally-formed mounting provisions for mounting, securing, or otherwise maintaining the control device 50 in connection with the door assembly 100. That is, the inner door panel 200 may be integrally formed, using heat, pressure, adhesive materials, and/or other composite material processing steps that will be appreciated by one skilled in the art such that the inner door panel 200 may be provided in substantially one piece (i.e., as a "single-piece" component), wherein no separate reinforcement panel or fasteners are required to form the inner door panel 200. One of ordinary skill in the art will appreciate that, in some instances, the control device 50 may be mounted, secured, or otherwise engaged to the decorative door panel 110 rather than the inner door panel 200.

In some embodiments, the inner door panel 200 may have a tub-facing liner surface 202 and a structural surface 204, wherein the liner surface 202 is positioned to be disposed toward the tub portion of the dishwashing appliance and the structural surface 204 generally opposes the liner surface 202 and faces outwardly therefrom. Thus, the structural surface 204 substantially opposes an interior surface 114 of the decorative panel 110 when coupled therewith to form the door assembly 100. The structural surface 204 may include one or more reinforcing members integrally-formed therewith for providing support and structure (i.e., reinforcement) to the inner door panel 200. The integrally-formed inner door panel 200 may thus stand on its own as a structural door assembly (thus, eliminating the need for the separate metal reinforcement member 104) capable of pivotably engaging the tub portion 12 of the dishwasher 10, wherein the decorative panel 110 is substantially non-structural and is provided essentially for appearance purposes. Accordingly, in some instances, the control device 50 may be at least partially disposed between the structural surface 204 and the interior surface 114 of the decorative door panel 110. However, in eliminating the metal reinforcement member 104 from the door assembly 100, the "flame barrier" function of the metal reinforcement member 104 is also substantially eliminated, and the control device 50 may still be at risk of undesirable contact with leaking fluids such as, for example, from the detergent dispenser 27 associated with the door assembly 100.

In accordance with embodiments of the present disclosure, with reference to FIGS. 5-7, the dishwasher 10 may thus include a protective arrangement 400 for the control device 50, the protective arrangement 400 comprising a protective member 410 for providing protection and/or isolation for the control device 50 mounted to the door assembly 100. As mentioned previously, the control device 50 may be exposed to various hazardous conditions when disposed within or otherwise associated with the door assembly 100. For example, fire or chemical exposure may severely damage the control device 50, possibly causing electrical issues/hazards. Alternatively, fire hazards may originate from the control device 50, wherein such hazards should be appropriately contained. Accordingly, the protective member 410 may be configured to provide appropriate protection and isolation for the control device 50 for reducing such risks.

In some instances, the protective-member 410 may be substantially planar and comprised of a deformable material such that the protective member 410 can at least partially extend about or otherwise surround, cover, and/or wrap about the control device 50 (which may include, for example, a control panel and/or timer device) to provide protection therefor. In such instances, the protective member 410 may include a first/leading end 412 and a second/trailing end 414, wherein the leading end 412 extends about the control device 50 such that the leading end 412 at least partially overlaps the trailing end 414. In other instances, the leading end 412 and the trailing end 414 may not overlap, but instead extend proximate to one another. As such, the protective member 410 may be at least partially disposed between the control device 50 mounted to the door assembly 100, as well as at least partially disposed between the control device 50 and the detergent dispensing device 27 (FIG. 2), so as to protect and/or isolate the control device 50 (i.e., protect the control device 50 from leaking fluid from the detergent dispensing device 27).

In some instances, the protective member 410 may define at least one crease 416 or other substantially linear portion for facilitating deformation of the protective member 410 along a defined line, which therefore facilitates wrapping of the protective member 410 about the control device 50. Furthermore, in some embodiments, the leading end 412 may be coupled to the trailing end 414 by a coupling member(s) 418 or other appropriate fastener, which may include, for example, an adhesive tape, a screw, a rivet, or other suitable fastening member, for maintaining the protective member 410 in position about the control device 50. The protective member 410 may be sufficiently thin so as to not interfere with the fit of the control device 50 within the dedicated, defined space of the door assembly 100, but may also be sufficiently flexible and robust so as to maintain its shape, size, and arrangement with respect to the control device 50 during manufacture and assembly of the dishwasher 10. The protective member 410 may be provided as a single component formed, for example, by a stamping process or other streamlined process, such that ease of assembly of the protective member 410 about the control device 50 can be improved.

Further, the protective member 410 may be suitably configured to receive therethrough projections or other structures projecting from the control device 50. For example, the protective member 410 may define one or more apertures, recesses, or cut-away portions such that the protective member 410 is capable of surrounding the control device 50 while suitably accommodating structural features of the control device 50. In some instances, for example, the protective member 410 may further define at least one aperture 420 for receiving a mounting device (not shown) therethrough for mounting the protective member 410 to the door assembly 100 or to receive a wiring arrangement 300 or other connector portions extending through the protective member 410 for connecting to (electrically or otherwise) or otherwise operably engaging the control device 50.

As mentioned previously, the protective member 410 may be comprised of a deformable material such that the protective member 410 may be appropriately deformed to be wrapped about the control device 50. Accordingly, the protective member 410 may be comprised of a durable, but appropriately flexible and/or durable material so as to permit at least partial wrapping of the protective member 410 about the control device 50. In some instances, the protective member 410 may be comprised of a composite film, such as, for example, a Mylar®/aluminum composite film that is, for example, deformable, durable, flexible, water-resistant, and/or flame-resistant. Such a composite film may be further configured to wrap or otherwise extend about the control device 50 so as to at least partially protect the control device 50 from contact with leaking fluid from the dishwasher 10 (i.e., from the detergent dispensing device 27), wherein the composite film may also be at least partially disposed between the control device 50 and the inner door member 150 or 200 so as to provide a "flame barrier" therebetween.

According to some embodiments, the protective member 410 may be comprised of a flame-resistant material, a chemical-resistant material, and/or a chafe-resistant material. As such, the protective member 410 may isolate the control device 50 from surrounding components/portions associated with the dishwasher 10 so as to reduce risk of damage/injury from fire, chemical, and chafing sources. Particularly, in instances where the door assembly 100 implements an integrally formed inner door panel 200, the protective member 410 may reduce/prevent fire, chemical and/or chafing damage to the control device 50, as well as restrict fires originating at the control device 50 from advancement to the inner door panel 200. That is, because the door assembly 100 having the integrally formed inner door panel 200 does not include the metal reinforcement member 104 (FIG. 3) for providing a "flame barrier," the protective member 410 may extend about, wrap or otherwise surround the control device 50 in an encompassing manner to provide such protection for the control device 50, while also acting as a flame barrier to contain or otherwise restrict a fire originating from the control device 50. Such a protective member 410 may eliminate the need for a separate flame barrier provision. In such instances, the protective member 410 may extend about the control device 50 so as to be at least partially disposed between the inner door panel 200 and the control device 50 and therefore provide such a flame barrier therebetween, in the absence of a separate metal reinforcement member 104 (FIG. 3).

Further, the protective member 410 may be configured to be water resistant and/or chemical resistant so as to be capable of reducing exposure of the casing, housing or other surrounding portion of the control device 50 to water and/or chemical exposure (i.e., due to rinse aid/dishwashing detergent/dishwashing fluid leaking from a detergent dispensing device 27 (FIG. 2), or to water intrusion from the interior of the tub into the space between the inner door panel 150 or 200 and the decorative panel 110) which could potentially cause a fire hazard. Thus, the protective member 410 may be particularly useful for preventing/reducing the risk of such water and/or chemical exposure of the control device 50 associated with door assemblies 100 for dishwashers employing either an inner door panel 150 with a separate reinforcement member 104, or inner door panel 200 without the reinforcement member 104, as shown in FIGS. 3 and 4, respectively.

The term "flame-resistant" material as used herein is defined as a material capable of substantially withstanding elevated temperatures, such as those associated with fire, such that the material maintains its structural integrity for containing a fire, preventing or otherwise limiting the advancement thereof, and/or preventing the fire from damaging structures surrounded by the material. For example, the protective member 410 may be constructed of a material having a UL94-HBF flammability rating. In some instances, the protective member 410 may be constructed of a suitable composite material such as, for example, a Mylar®/aluminum composite film or any other suitable material.

The term "chemical-resistant" material as used herein is defined as a material capable of substantially withstanding degradation, disintegration and/or destruction when exposed to chemicals that may be associated with a dishwashing appliance. For example, the protective member 410 may be constructed of a material resistant to the deteriorating effects of rinse aid agents. For example, the protective member 410 may be constructed of a suitable composite material such as, for example, a Mylar®/aluminum composite film or any other suitable material.

The term "chafe-resistant" material as used herein is defined as a material capable of substantially withstanding destruction and/or degradation caused by frictional forces from a structure/feature rubbing, chaffing, contacting or otherwise acting thereon. For example, the protective member 410 may be constructed of a chafe-resistant and durable composite material such as a Mylar®/aluminum composite film or any other suitable material.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwashing appliance comprising:

a tub portion defining a forward access opening;

a door assembly configured to cooperate with the tub portion to cover the forward access opening, wherein the door assembly comprises an outer door panel and an inner door panel engaged with one another;

a detergent dispensing device operably engaged with the door assembly so as to be capable of interacting with dishwashing fluid circulated within an interior of the tub portion;

a control device mounted to the door assembly and adapted to selectively direct operation of at least one operational component of the dishwashing appliance, wherein the outer and inner door panels define a space therebetween for enclosing the control device; and a protective member configured to wrap about the control device so as to be at least partially disposed between the control device and door assembly, the protective member being further disposed between the detergent dispensing device and the control device to at least partially prevent contact between dishwashing fluid from the detergent dispensing device and the control device, wherein the protective member comprises a deformable material and is configured to be wrapped about the control device such that the protective member is at least partially disposed between the control device and the outer and inner door panels.

2. A dishwashing appliance according to claim 1, wherein the protective member is substantially planar, the protective member further comprising a leading end and a trailing end, and being configured to be wrapped about the control device such that the leading end at least partially overlaps the trailing end.

3. A dishwashing appliance according to claim 2 further comprising a coupling device configured to couple the leading end to the trailing end to maintain the protective member about the control device.

4. A dishwashing appliance according to claim 1 wherein the protective member defines a plurality of creases extending along an axis for facilitating wrapping of the protective member about the axis and the control device.

5. A dishwashing appliance according to claim 1 wherein the protective member defines at least one aperture configured to at least one of receive a mounting device therethrough for mounting the protective member to the door assembly and receive wiring therethrough for electrical connection to the control device.

6. A dishwashing appliance according to claim 1 wherein the protective member is comprised of one of a heat resistant and fire resistant material.

7. A dishwashing appliance according to claim 1 wherein the protective member comprises at least one of a chemical resistant and chafe resistant material.

8. A dishwashing appliance according to claim 1, wherein the inner door panel does not include a metal reinforcement member and comprises a polymeric material, and wherein the protective member encompasses the control device so as to be disposed between the control device and the inner door panel to provide a flame barrier therebetween.

9. A dishwashing appliance according to claim 1, wherein the protective member comprises a composite film of polyester and aluminum.

10. A dishwashing appliance according to claim 1, wherein the protective member is fire, chafe, and chemical resistant.

11. A protective assembly for a dishwashing appliance having a tub portion defining a forward access opening, the dishwashing appliance having a door assembly being pivotably engaged with the tub portion and adapted to cooperate with the tub portion to cover the forward access opening, wherein the door assembly comprises an outer door panel and an inner door panel engaged with one another, and the dishwashing appliance further having a control device mounted to the door assembly and adapted to selectively direct operation of at least one operational component of the dishwashing appliance, wherein the outer and inner door panels define a space therebetween for enclosing the control device, the protective assembly comprising:

a substantially planar protective member comprised of a deformable material, the protective member having a leading end and a trailing end, and being adapted to be wrapped about a control device mounted to a door assembly of a dishwashing appliance such that the leading end at least partially overlaps the trailing end, the protective member thereby being at least partially disposed between the control device and the door assembly so as to at least one of protect and isolate the control device.

12. A protective assembly according to claim 11 further comprising a coupling member configured to couple the leading end to the trailing end to maintain the protective member about the control device.

13. A protective assembly according to claim 11 wherein the protective member defines at least one crease for facilitating wrapping of the protective member about the control device.

14. A protective assembly according to claim 11 wherein the protective member defines at least one aperture configured to at least one of receive a mounting device therethrough for mounting the protective member to the door assembly and receive wiring therethrough for electrical connection to the control device.

15. A protective assembly according to claim 11 wherein the protective member is comprised of one of a heat resistant and fire resistant material.

16. A protective assembly according to claim 11 wherein the protective member comprises at least one of a chemical resistant and chafe resistant material.

17. A method of protecting a control device mounted to a door assembly of a dishwashing appliance, wherein the door assembly comprises an outer door panel and an inner door panel engaged with one another, the outer and inner doorpanels defining a space therebetween for enclosing the control device, the dishwashing appliance having a tub portion defining a forward access opening, the door assembly being pivotably engaged with the tub portion and adapted to cooperate with the tub portion to cover the forward access opening, the dishwashing appliance further having a detergent dispensing device operably engaged with the door assembly so as to be capable of interacting with dishwashing fluid circulated within an interior of the tub portion, and the control device adapted to selectively direct operation of at least one operational component of the dishwashing appliance, the method comprising:

wrapping a protective member comprised of a deformable material about a control device mounted to a door assembly of a dishwashing appliance such that the protective member is at least partially disposed between the control device and door assembly, and such that the protective member is further disposed between the detergent dispensing device and the control device to at least partially prevent contact between dishwashing fluid from the detergent dispensing device and the control device;

wherein wrapping the protective member about the control device further comprises wrapping the protective member about the control device such that the protective member is at least partially disposed between the control device and the outer and inner door panels.

18. A method according to claim 17 wherein wrapping the protective member about the control device further comprises wrapping a substantially planar protective member about the control device, the protective member further comprising a leading end and a trailing end, such that the leading end at least partially overlaps the trailing end.

19. A method according to claim 18 further comprising coupling the leading end to the trailing end to maintain the protective member about the control device.

20. A method according to claim 17 wherein wrapping a protective member about a control device further comprises wrapping a protective member defining at least one crease about the control device, the at least one crease facilitating wrapping of the protective member about the control device.

21. A method according to claim 17 wherein wrapping a protective member about a control device further comprises wrapping a protective member defining at least one aperture about the control device, the at least one aperture being configured to at least one of receive a mounting device therethrough for mounting the protective member to the door assembly and receive wiring therethrough for electrical connection to the control device.

22. A method according to claim 17 wherein wrapping a protective member about a control device further comprises wrapping a protective member comprised of one of a heat resistant and fire resistant material about the control device.

23. A method according to claim 17 wherein wrapping a protective member about a control device further comprises wrapping a protective member comprised of one of a chemical resistant and chafe resistant material about the control device.

* * * * *

UNITED STATES PATENT AND TRADEMARK OFFICE

CERTIFICATE OF CORRECTION

PATENT NO. : 8,398,782 B2
APPLICATION NO. : 12/164568
DATED : March 19, 2013
INVENTOR(S) : Poyner et al.

It is certified that error appears in the above-identified patent and that said Letters Patent is hereby corrected as shown below:

In the Specifications:

Column 7,
Line 22, “protective-member” should read --protective member--.

In the Claims:

Column 11,
Lines 24 and 25, “doorpanels” should read --door panels--.

Column 12,
Line 4, “device;” should read --device,--.

Signed and Sealed this
Second Day of July, 2013

Teresa Stanek Rea
*Acting Director of the United States Patent and Trademark Office*